US005690426A

United States Patent [19]

Sherman

[11] Patent Number: 5,690,426

[45] Date of Patent: Nov. 25, 1997

[54] READING LAMP ASSEMBLY REMOVABLY AND ADJUSTABLY ATTACHABLE TO A TORCHIERE-TYPE LAMP

[75] Inventor: Roger N. Sherman, Jamaica Plain, Mass.

[73] Assignee: Tensor Corporation, Chelsea, Mass.

[21] Appl. No.: 772,489

[22] Filed: Dec. 23, 1996

Related U.S. Application Data

[60] Provisional application No. 60/027,472, Sep. 26, 1996.

[51] Int. Cl. [6] ..... F21S 1/12; F21V 21/22

[52] U.S. Cl. ..... 362/410; 362/287; 362/396; 362/401

[58] Field of Search ..... 362/249, 250, 362/252, 285, 287, 288, 370, 396, 403, 410, 414, 418, 431, 401, 296

[56] References Cited

U.S. PATENT DOCUMENTS 1,648,125 11/1927 Horne ..... 362/414

5,221,141 6/1993 Swanson ..... 362/250

FOREIGN PATENT DOCUMENTS 188880 11/1922 United Kingdom ..... 362/410

*Primary Examiner*—Y. My Quach

*Attorney, Agent, or Firm*—John L. Welsh

[57] ABSTRACT

A reading lamp assembly can be removably and adjustably attached to the vertical pole of a torchiere-type floor lamp. The reading lamp itself is mounted at the distal end of a short arm. A resilient clip encircles or surrounds the pole and includes a pair of parallel tabs projecting outwardly. A fitting at the proximal end of the lamp arm inter-engages with the tabs to support the arm and lamp. Preferably, the tabs are apertured and the fitting includes opposed pins which fit within the apertures, thereby allowing a limited pivotal movement of the arm around the horizontal axis. The arm preferably includes a portion projecting inwardly below the axis so that the weight of the lamp causes the projecting portion to engage the pole and restrain the assembly from sliding downwardly.

3 Claims, 3 Drawing Sheets

READING LAMP ASSEMBLY REMOVABLY AND ADJUSTABLY ATTACHABLE TO A TORCHIERE-TYPE LAMP

RELATED APPLICATION

The present application claims the benefit of U.S. Provisional Application No. 60/027,472, filed on Sep. 26, 1996, which is hereby incorporated herein by reference.

BACKGROUND OF THE INVENTION

The present invention relates to a reading lamp and more particularly to a reading lamp assembly which can be selectively attached to the vertical pole of a torchiere-type lamp.

Various pole lamp constructions have been proposed heretofore which incorporate one or more reading lamp fixtures permanently mounted at various heights along a vertical pole. Torchiere-type lamps are currently undergoing a resurgence in popularity, particularly those provided with high temperature halogen bulbs. Most torchiere-type lamps, however, do not include any provision for including a reading lamp type of capability. Typically, the support for the torchiere-type lamp housing is an unornamented vertical pole or tube.

Among the several objects of the present invention may be noted the provision of a reading lamp assembly which can be selectively attached to the vertical support pole of a torchiere-type lamp; the provision of such assembly which does not require any modification or dis-assembly of the torchiere-type floor lamp; the provision of such a lamp assembly which can be readily attached or detached; the provision of such a lamp assembly in which the height of the attachment point can be easily changed; and the provision of such a lamp assembly which is highly reliable and which is of relatively simple and inexpensive construction. Other objects and features will be in part apparent and in part pointed out hereinafter.

SUMMARY OF THE INVENTION

A reading lamp assembly constructed in accordance with the present invention can be selectively attached to the vertical pole of a torchiere-type lamp. A reading lamp fixture is mounted at the distal end of an elongate arm. The arm is attached to the pole using a resilient clip having a pole-surrounding portion and, extending from the surrounding portion, a pair of tabs projecting outwardly. The proximal end of the arm includes a fitting which inter-engages with the tabs to support the arm and the lamp.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
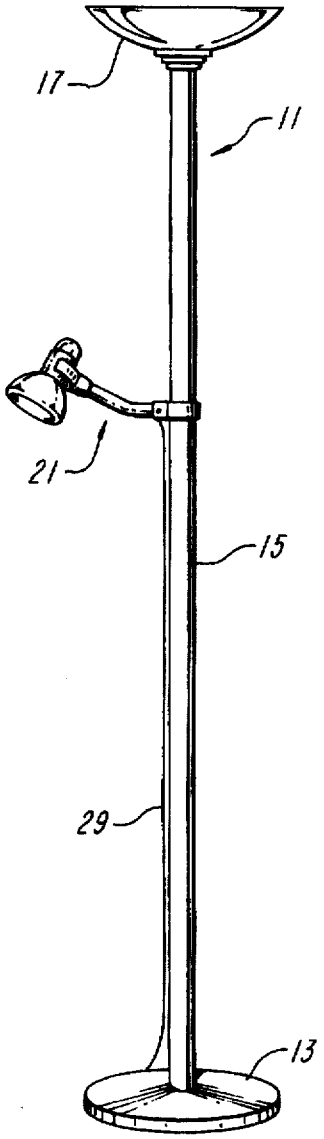
FIG. 1 illustrates a reading lamp assembly in accordance with the present invention attached to the vertical support pole of a torchiere-type lamp.

Referring now to FIG. 1, a conventional torchiere-style floor lamp is designated generally by reference character 11. Lamp 11 includes a base 13, a vertically oriented cylindrical tube or support pole 15 and, at the top of the pole 15, a lamp housing 17. A reading lamp assembly 21 constructed in accordance with the present invention is mounted on the pole 15 about two-thirds of the way up.

Figure 2:
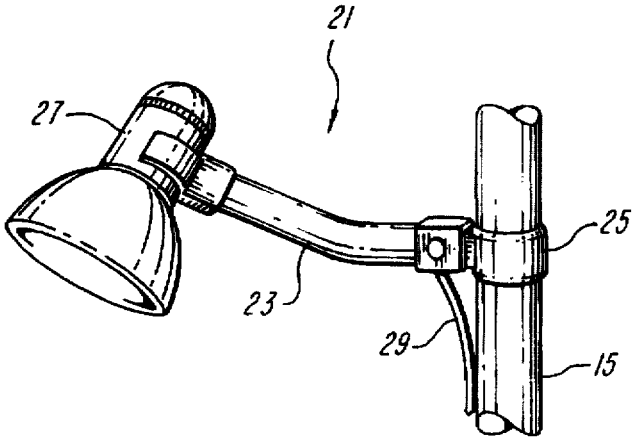
FIG. 2 shows the reading lamp assembly and its attachment to larger scale.

As illustrated in FIG. 2, the lamp assembly 21 includes an elongate arm 23 which is attached, at its proximal end, to the support pole 15 by a clip assembly 25 described in greater detail hereinafter. The arm 23 may, for example, be a hollow metal or plastic tube. A shroud-type reading lamp 27 is mounted at the distal end of the arm 23. Preferably the power cord for lamp 27 passes through the arm 23 but exits the arm near its proximal end and extends down generally alongside the support pole 15 as indicated by reference character 29 so that no modification of the pole 15 is required for installation of the reading lamp.

Figure 3:
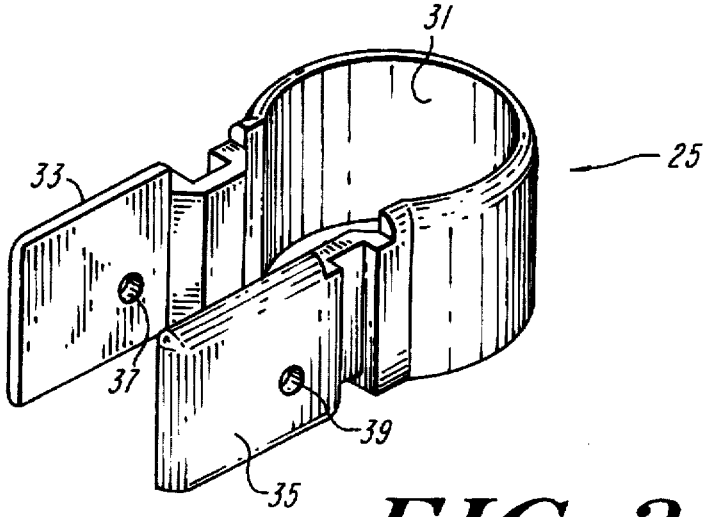
FIG. 3 illustrates a resilient clip employed in the lamp assembly of FIGS. 1 and 2.
Figure 4:
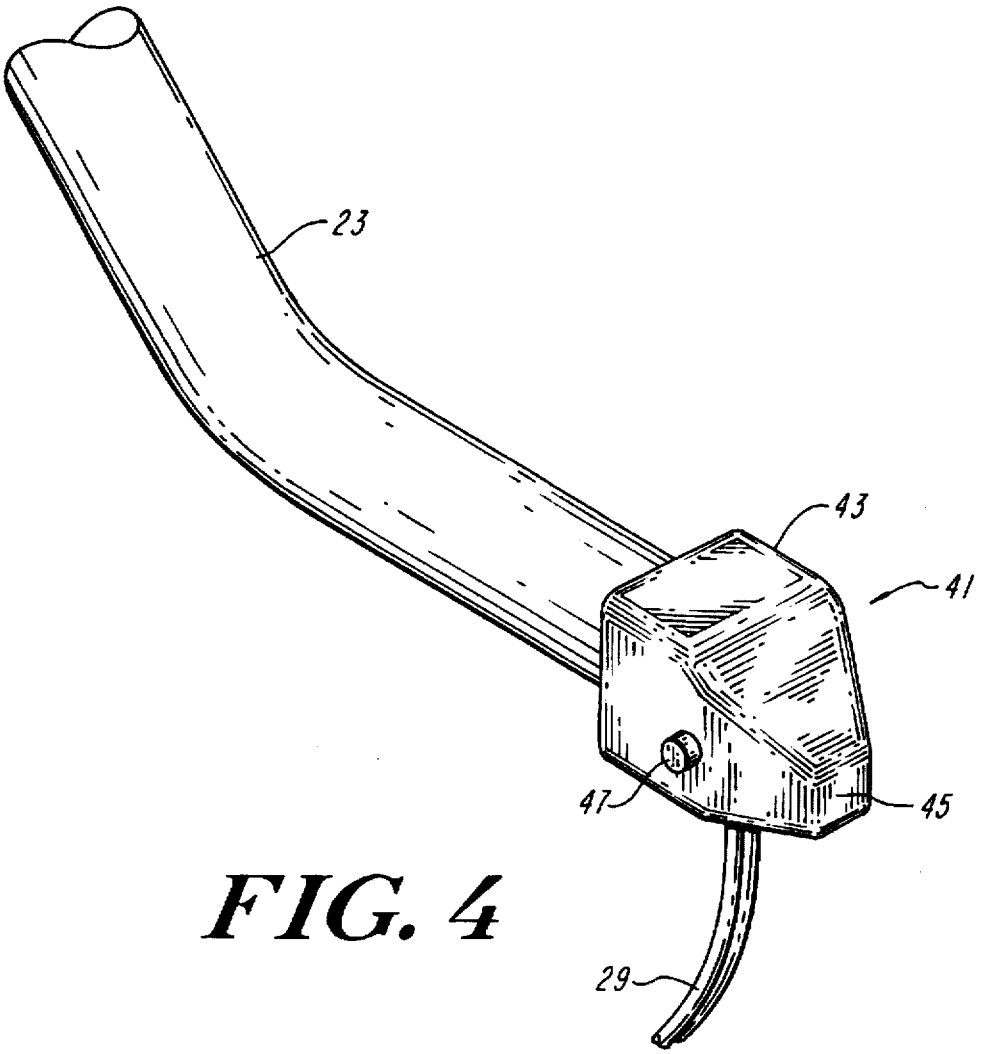
FIG. 4 illustrates the proximal end of an elongate arm element employed in the lamp assembly of FIGS. 1 and 2.

The clip 25 is illustrated in greater detail in FIG. 3 and includes a portion 31 which encircles or surrounds the support pole 15 together with a pair of ears or tabs 33 and 35 projecting outwardly. Clip 25 is constructed of a resilient material, e.g. the clip may be injection molded from an acrylonitrile-butadiene-styrene (ABS) resin. Further, the encircling or surrounding portion 31 is discontinuous or interrupted between the tabs 33 and 35 so that the clip can be expanded or spread open, for being applied to the pole from one side thereof, without requiring the torchiere-type lamp to be disassembled. The tabs 33 and 35 are apertured as indicated by reference characters 37 and 39.

The proximal end of the arm 23 carries a fitting 41 which inter-engages with the tabs 33 and 35 to support the arm and the lamp 27. The fitting 41 may also be injection molded of an ABS resin. The fitting 41 includes a portion 43 which is of generally rectangular cross-section so as to fit closely between the parallel internal faces of the tabs 33 and 35, and also includes a downwardly bevelled, projecting nose portion 45 whose function is described in greater detail hereinafter. The fitting provides, on either side of the rectangular section 43, a pin or nub 47. The nubs fit into the apertures 37 and 39 of tabs 33 and 35, and establish a horizontal axis allowing limited pivotal movement of the arm 23. While the apertures 37 and 39 are shown as passing entirely through the respective tab portions 33 and 35 extending from the clip, it should be understood that they might also be blind recesses formed in the interior surfaces of the tabs.

Figure 5:
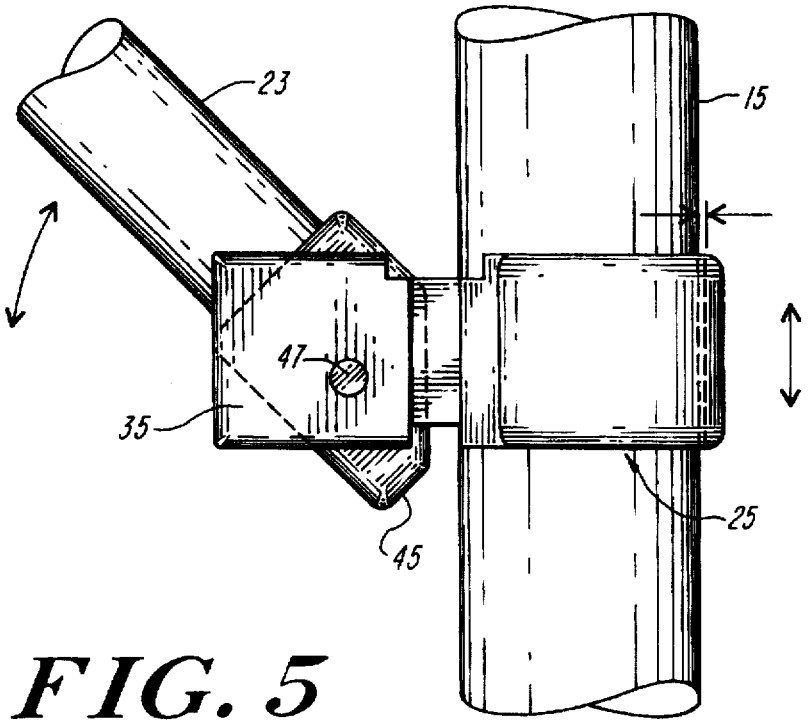
FIG. 5 illustrates, to enlarged scale, the attachment of the clip of FIG. 3 and the arm of FIG. 4 to a lamp support pole.
Figure 6:
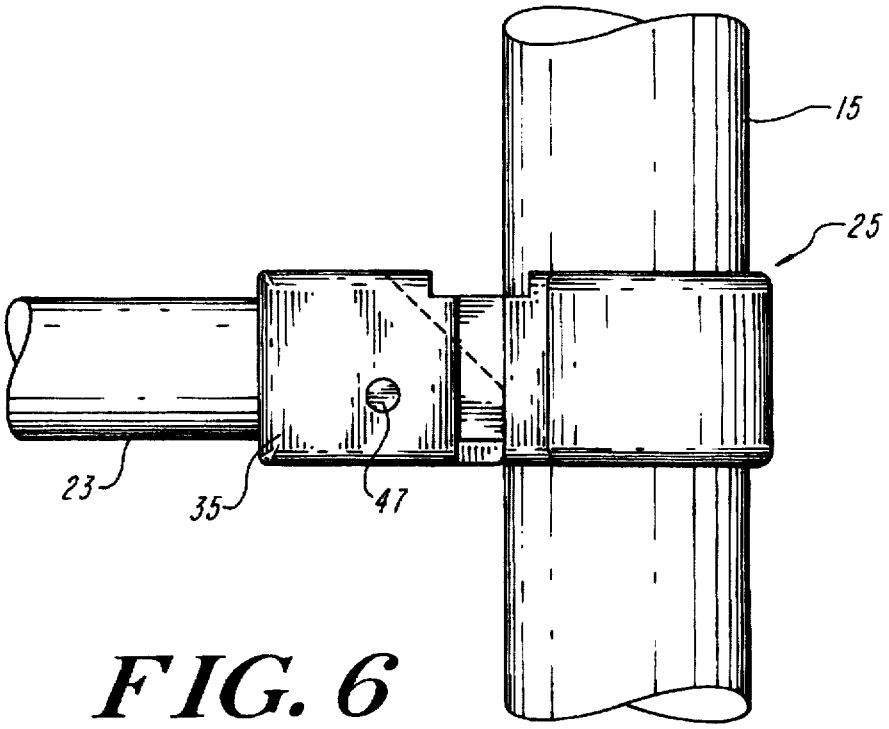
FIG. 6 is a figure similar to FIG. 5 illustrating the manner in which the attachment secures the reading lamp at a selected height on the support pole.

When the clip 25 has been resiliently forced over the support pole 15, the fitting 41 can be easily snapped into the space between the two tabs 33 and 35 when the arm 23 is in a slightly raised position as illustrated in FIG. 5. With the arm 23 held in this attitude, the height of the reading lamp assembly along the vertical support pole 15 may be easily adjusted by sliding the assembly up or down along the pole. However, when the arm is allowed to return to the horizontal position as illustrated in FIG. 6, the projecting nose 45, which is somewhat below the pivot axis, will press against the side of the support pole or tube 15 and effectively lock the assembly at the desired height, i.e. so that it cannot slide down the pole.

Clip 25 may be provided in several standard sizes so that circular portion 31 will conform to various sizes of support poles: for example, diameters of 1 inch, 1 and ¼ inch, and 1 and ½ inch. In each case, however, the spacing between tab portions 33 and 35 remains the same, so that the same fitting 41 may be utilized with each of differently-sized clips.

In view of the foregoing it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. A reading lamp assembly for selective attachment to a vertical support pole of a torchiere-type lamp, said assembly comprising:

an arm;

a reading lamp mounted at one end of said arm;

a resilient clip having an annular portion configured to surround said vertical pole and, a pair of tabs projecting outwardly and extending from said annular portion, said annular portion being interrupted between said tabs to allow said clip to be expanded for applying to the pole from one side of said pole; and a fitting mounted at another end of said arm which interengages with said tabs supporting said arm and lamp and allows limited pivotal movement of said arm around a horizontal axis, said fitting including a portion which projects inwardly with respect to said annular portion below said axis, the weight of said lamp causing said projecting portion to engage said pole and restrain said assembly from sliding down said pole.

2. An assembly as set forth in claim 1 wherein said tabs includes apertures and said fitting includes laterally projecting nubs which fit within the apertures to define said axis.

3. A reading lamp assembly for selective attachment to a vertical pole of a torchiere-type lamp, said assembly comprising:

an arm;

a reading lamp mounted at one end of said arm;

a resilient clip having a pole encircling annular portion and, a pair of parallel tabs projecting outwardly and extending from said annular portion, said annular portion being interrupted between said tabs to allow said clip to be expanded for applying to the pole from one side of said pole, said tabs having respective apertures aligned on a horizontal axis; and a fitting mounted at another end of said arm which fits between said tabs supporting said arm and lamp, said fitting including laterally projecting pins which fit within said apertures to allow limited pivotal movement of said arm around said horizontal axis, said fitting including a portion projecting inwardly with respect to said annular portion below said axis, the weight of said lamp causing said projecting portion to engage said pole and restrain said assembly from sliding down said pole.

* * * * *